US005572743A

United States Patent [19]

Yavitz

[11] Patent Number: 5,572,743

[45] Date of Patent: Nov. 12, 1996

[54] SURGICAL GOWN

[76] Inventor: Edward Q. Yavitz, 3828 Spring Creek Rd., Rockford, Ill. 61114

[21] Appl. No.: 255,095

[22] Filed: Jun. 7, 1994

[51] Int. Cl.[6] ..... A41B 7/08; A41D 13/12

[52] U.S. Cl. ..... 2/125; 2/123; 2/51; 2/114; 2/161.7

[58] Field of Search ..... 2/59, 60, 170, 2/16, 114, 107, 117, 125, 51, 901, 123, 161.7, 270, 168

[56] References Cited

U.S. PATENT DOCUMENTS

| | | | |
|---|---|---|---|
| 815,998 | 3/1906 | Wolff | 2/59 |
| 2,655,663 | 10/1953 | Hoagland | 2/170 |
| 3,045,815 | 7/1962 | Abildgaard | 2/114 |
| 3,889,297 | 6/1975 | Jarboe et al. | 2/16 |
| 4,114,200 | 9/1978 | Smith et al. | 2/51 |
| 4,226,748 | 10/1980 | Matsunaga et al. | 260/17 A |
| 4,389,734 | 6/1983 | Franz et al. | 2/59 |
| 4,479,268 | 10/1984 | Tillbrook | 2/170 |
| 5,001,785 | 3/1991 | Heiman et al. | 2/51 |
| 5,033,115 | 7/1991 | Bowling et al. | 2/901 |
| 5,142,704 | 9/1992 | Viemeister et al. | 2/901 |

FOREIGN PATENT DOCUMENTS

| | | | |
|---|---|---|---|
| 2531616 | 2/1984 | France | 2/60 |

*Primary Examiner*—Amy B. Vanatta
*Attorney, Agent, or Firm*—Foley & Lardner

[57] ABSTRACT

A surgical garment for use with elastic surgical gloves is disclosed. The garment includes a body portion that at least partially covers the wearer's torso. The garment also includes a pair of sleeves which extend into proximity with the wrists of the wearer. At least one stiffener ring is attachable to each sleeve in proximity to the distal end or wrist area of the sleeve and is thus disposed to underlie the surgical gloves when worn. The stiffener rings apply an outward force against the elastic surgical gloves to alleviate pressure against the wrists of the wearer.

12 Claims, 2 Drawing Sheets

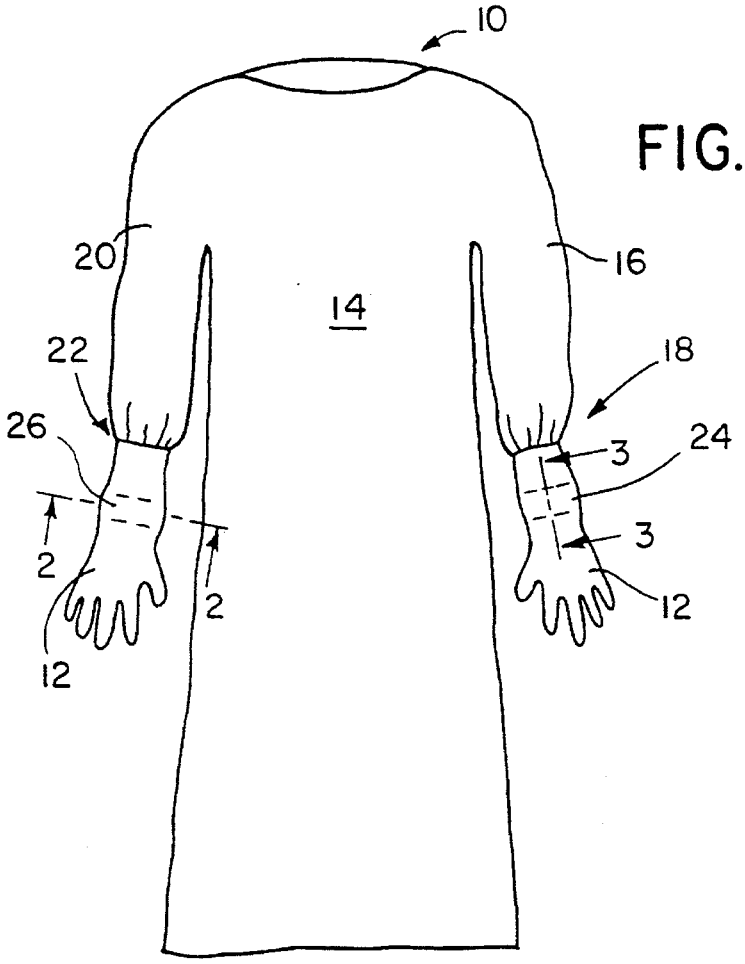
FIG. 1
FIG. 2
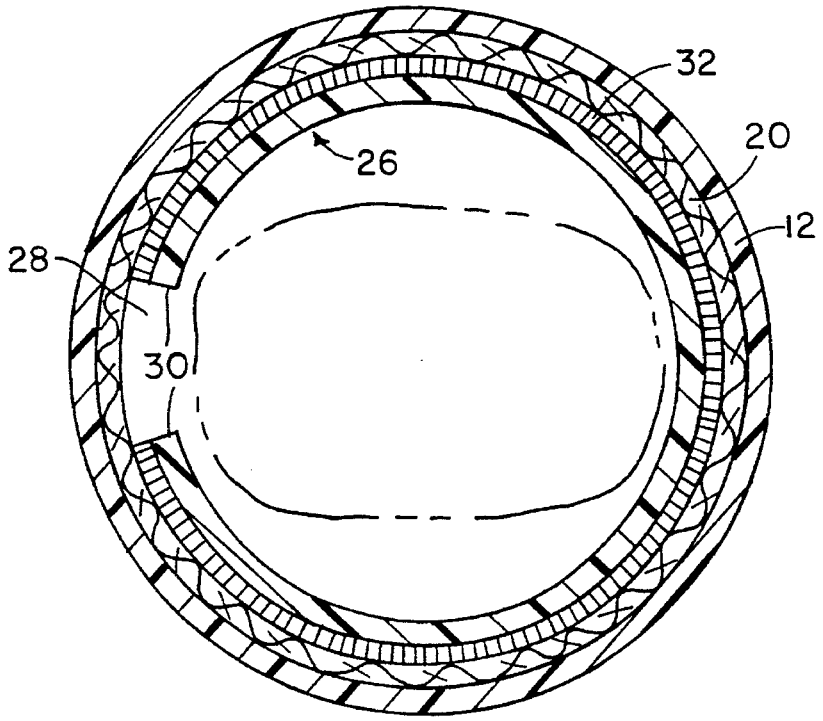

SURGICAL GOWN

FIELD OF THE INVENTION

The present invention relates generally to a device and method for alleviating the pressure caused by surgical gloves against the wrists of a surgeon or other wearer, and particularly to an improved surgical gown having stiffener rings disposed in the wrist area of the sleeves to lessen the pressure applied by the surgical gloves.

BACKGROUND OF THE INVENTION

During surgical and other medical procedures, nurses and doctors wear tight fitting, elastic surgical gloves. For example, during an operation, a surgeon typically wears a disposable surgical gown having long sleeves that generally extend to his or her wrists. Tight fitting rubber or plastic surgical gloves are stretched over the surgeon's hands, and the wrist portion of each glove overlies the sleeve to provide a continuous covering of the arms and hands.

A problem with this arrangement is the constant pressure applied by the surgical gloves against the wrist areas of the user. The elastic gloves constantly squeeze the wrists of the user and can cause discomfort or injury. Doctors who perform lengthy surgical operations can develop a variety of repetitive motion conditions, such as carpal tunnel syndrome, from this constant pressure. Additionally, the pressure makes movement of the wrist more difficult and causes fatigue and soreness.

The elasticity of the surgical gloves, however, is necessary to maintain the gloves in a tight fitting relationship over the hands of the user. The tight fit facilitates dexterity and an ability to cleanly and smoothly grasp the various instruments.

The present invention addresses the various drawbacks of existing surgical gowns and surgical gloves.

SUMMARY OF THE INVENTION

The present invention features a garment for use during surgical procedures in which the wearer of the garment also wears surgical gloves. The garment includes a body portion configured to at least partially cover the torso of a wearer. A first sleeve extends from the body portion and includes a first distal end which lies in proximity to the wrist of the wearer when the garment is used. A second sleeve also extends from the body portion and has a second distal end similar to the first distal end. A first stiffener ring is configured to cooperate with the first sleeve proximate the first distal end. A second stiffener ring is configured to cooperate with the second sleeve proximate the second distal end. Both stiffener rings are disposed on their respective sleeves to underlie the surgical gloves when worn by the nurse or doctor. The stiffener rings effectively apply an outward force which removes at least some of the pressure of the surgical gloves that would normally bear against the wrist area of the wearer.

According to another aspect of the invention, a method is provided for alleviating the pressure caused by a surgical glove against the wrist area of the wearer. The method includes the step of applying an outward force to the surgical glove in proximity to the wrist of the wearer. A second step is retaining the surgical glove in position on the hand of the wearer so the glove remains tight about the fingers to facilitate surgical procedures.

BRIEF DESCRIPTION OF THE DRAWINGS

The invention will hereafter be described with reference to the accompanying drawings, wherein like referenced numerals denote like elements, and:

FIG. 1 is a front elevation view of a surgical garment having stiffener rings according to a preferred form of the present invention;

FIG. 2 is a cross-sectional view taken generally along line 2—2 of FIG. 1;

DETAILED DESCRIPTION OF THE PREFERRED EMBODIMENTS

Figure 3:
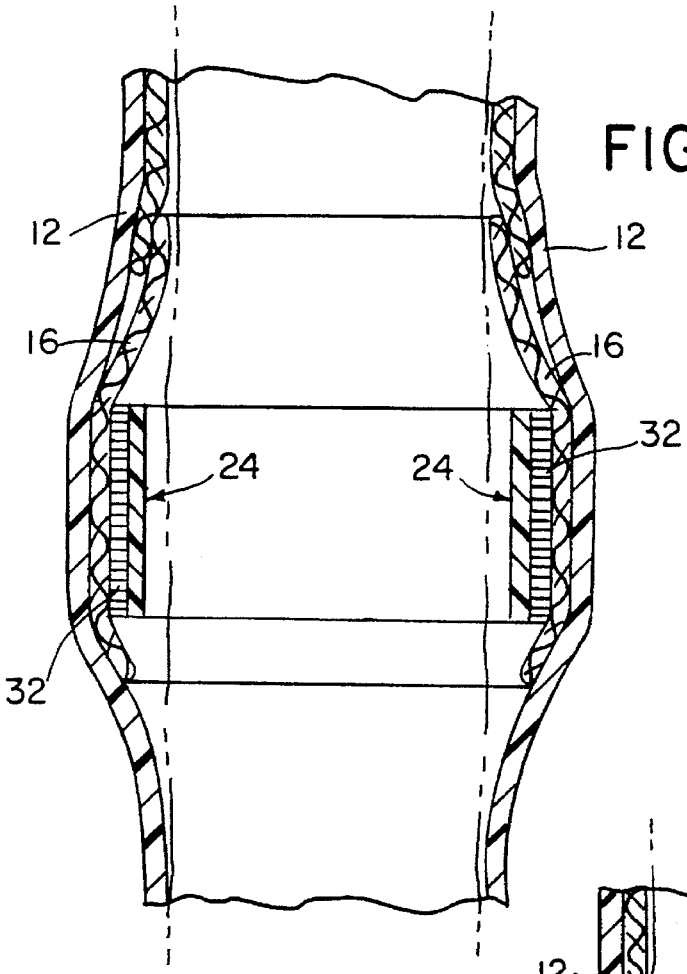
FIG. 3 is a cross-sectional view taken generally along line 3—3 of FIG. 1.

A preferred embodiment of a garment 10, according to the present invention, is illustrated in FIG. 1. Garment 10 is typically a surgical gown worn by medical doctors and nurses during surgical procedures. The garment may be made of a variety of materials, including cloth, such as cotton, or disposable paper products. Garment 10 is usually used with a pair of surgical gloves 12.

Garment 10 includes a body portion 14 designed to at least partially cover the torso of the person wearing the garment. A first sleeve 16 extends from body portion 14 and includes a first distal end 18 disposed to lie generally about a wrist of the wearer. A second sleeve 20 also extends from body portion 14, generally opposite first sleeve 16, and includes a second distal end 22 disposed to lie generally about the opposite wrist of the wearer. Each surgical glove 12 overlies the distal end or cuff of the corresponding sleeve to provide a continuous covering of the wearer's arms and hands.

A first stiffener ring 24 cooperates with first sleeve 16 at first distal end 18. Preferably, first stiffener ring 24 is disposed to lie in proximity to the general wrist area of the wearer. Thus, when surgical glove 12 is stretched over first distal end 18, first stiffener ring 24 will effectively provide an outward force against the portion of surgical glove 12 overlying the wrist of the wearer. This will lessen the pressure against the wrist and reduce fatigue, as well as the chance of injury, such as that resulting from carpal tunnel syndrome.

Similarly, a second stiffener ring 26 cooperates with second sleeve 20 in general proximity to second distal end 22. Second stiffener ring 26 also alleviates the pressure which would otherwise be applied by the corresponding surgical glove 12 against the wrist of the wearer.

Stiffener rings 24 and 26 may be made of a variety of materials and may cooperate with sleeves 16 and 20 in a variety of ways. For example, the stiffener rings may be made of a flexible plastic, layers of cloth, cardboard or paper products, flexible metal bands, starch, or a variety of other products or combinations of products. The stiffener rings may also be integrated with the sleeves. For example, the sleeves may incorporate a stiffer material in the wrist area or the sleeve may be chemically treated or treated with a polymer or resin to provide a stiffer region in the wrist area. Regardless of the material, the stiffener rings should be stiff enough to alleviate at least some of the centripetally directed force applied by the elastic surgical gloves against the wrist of the wearer. Preferably, the stiffener rings also have enough flexibility to accommodate insertion and removal of the user's hands.

Stiffener rings 24 and 26 may also be designed to cooperate with their corresponding sleeves and surgical gloves in a variety of ways. Preferably, each stiffener ring is attached to a corresponding sleeve in general proximity to its distal end, although the stiffener rings could be inserted or attached to the surgical gloves.

As illustrated in FIG. 2, second stiffener ring 26 is releasably attached to the inside of second sleeve 20 and is configured to encircle at least a portion of the wearer's wrist area. Stiffener ring 26 could extend along the entire circumference of second sleeve 20, but it is preferably split to include a gap 28 disposed between a pair of ring ends 30. Splitting the stiffener rings allows them to expand and contract as the wearer's hand and wrist are inserted and retracted therethrough. In the embodiment illustrated in FIG. 2, second stiffener ring 26 includes an external. VELCRO hook and loop type layer 32 which is attachable to the cloth inside second sleeve 20. However, second stiffener ring 26 could also be attached to second sleeve 20 by a variety of adhesives, thread, tape, or other attachment structures. Additionally, the stiffener ring could be disposed on the outside surface of the sleeve or integral with the sleeve. The description of second stiffener ring 26 and its cooperation with second sleeve 20 applies equally to first stiffener ring 24 and its cooperation with first sleeve 16.

As illustrated in FIG. 3, stiffener rings 24 and 26 are designed to effectively direct an outward force against the overlying surgical glove to alleviate pressure against the wrist of the wearer. The surgical glove is often somewhat stretched outwardly by the stiffener ring which also helps prevent the gloves from loosening or slipping downwardly off the wrists of the wearer.

Figure 4:
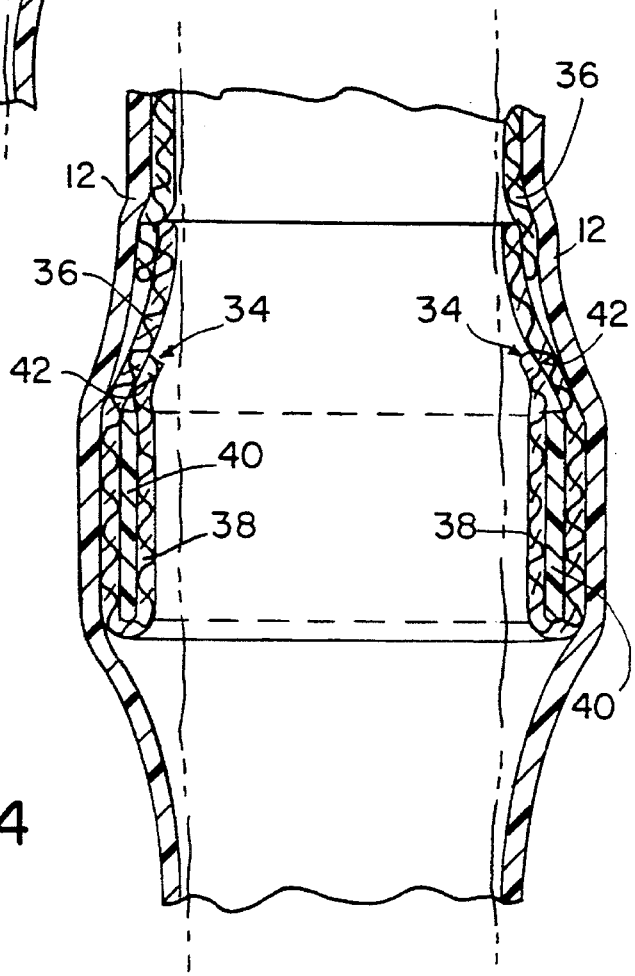
FIG. 4 is a cross-sectional view similar to FIG. 3 showing an alternate embodiment of the present invention.

An alternate embodiment of the surgical garment is illustrated in FIG. 4. In this embodiment, a distal end or cuff 34 of a sleeve 36 includes a flap portion 38 which is folded around a stiffener ring 40. Flap portion 38 is folded back against distal end 34 and secured thereto by any of a variety of structures such as sewn threads 42 or adhesive. The stiffener ring 40 is held between flap portion 38 and the remainder of distal end 34 to prevent its removal.

It will be understood that the foregoing description is of preferred exemplary embodiments of this invention and that the invention is not limited to the specific forms shown. For example, the stiffener rings may be made in a variety of shapes and lengths. Additionally, the garment, including the stiffener rings, may comprise a variety of different materials. Also, the stiffener rings could be constructed for attachment directly to the surgical gloves to facilitate application of the outward force to the surgical glove in proximity to the rest of the wearer. These and other modifications may be made in the design and arrangement of the elements without departing from the scope of the invention as expressed in the appended claims.

What is claimed is:

1. A sleeve assembly for use with a surgical garment, the sleeve assembly comprising:

a generally tubular section through which an arm of the wearer extends;

a wrist portion disposed at a distal end of the tubular section;

a plastic strip attached to the wrist portion; and a stretchable, elastic surgical glove stretched over the wrist portion and the plastic strip, wherein the plastic strip resists the pressure applied by the stretchable, elastic surgical glove to reduce pressure against the wearer's wrist, wherein the plastic strip comprises a hook and loop type fastener attachable to the wrist portion.

2. The sleeve as recited in claim 1, wherein the hook and loop type fastener includes a hook portion and a loop portion, the hook portion being attached to the wrist portion.

3. The sleeve as recited in claim 1, wherein the hook and loop type fastener includes a hook portion and a loop portion, the loop portion being attached to the wrist portion.

4. A sleeve assembly for use with a surgical garment, the sleeve assembly comprising:

a generally tubular section through which an arm of the wearer extends;

a wrist portion disposed at a distal end of the tubular section;

a plastic strip attached to the wrist portion; and a stretchable, elastic surgical glove stretched over the wrist portion and the plastic strip, wherein the plastic strip resists the pressure applied by the stretchable, elastic surgical glove to reduce pressure against the wearer's wrist, wherein the wrist portion includes a flap which is folded back over the plastic strip to trap the plastic strip between the flap and the remainder of the wrist portion.

5. The sleeve as recited in claim 4, wherein the plastic strip extends about the circumference of the wrist portion.

6. The sleeve as recited in claim 4, wherein the plastic strip extends about a portion of the circumference of the wrist portion.

7. A sleeve assembly for use with a surgical garment, the sleeve assembly comprising:

a generally tubular section through which an arm of the wearer extends;

a wrist portion disposed at a distal end of the tubular section;

a plastic strip attached to the wrist portion; and a stretchable, elastic surgical glove stretched over the wrist portion and the plastic strip, wherein the plastic strip resists the pressure applied by the stretchable, elastic surgical glove to reduce pressure against the wearer's wrist, wherein the plastic strip comprises a polymer integral with the sleeve.

8. The sleeve as recited in claim 7, wherein the polymer is impregnated into the sleeve.

9. The sleeve as recited in claim 4, wherein the plastic strip extends along a portion of the circumference of the sleeve.

10. A sleeve assembly for use with a surgical garment, the sleeve assembly comprising:

a generally tubular section through which an arm of the wearer extends;

a wrist portion disposed at a distal end of the tubular section;

a plastic strip attached to the wrist portion; and a stretchable, elastic surgical glove stretched over the wrist portion and the plastic strip, wherein the plastic strip resists the pressure applied by the stretchable, elastic surgical glove to reduce pressure against the wearer's wrist, wherein the plastic strip comprises a resin integral with the sleeve.

11. The sleeve as recited in claim 10, wherein the resin is impregnated into the sleeve.

12. The sleeve as recited in claim 10, wherein the plastic strip extends along a portion of the circumference of the sleeve.

* * * * *